US010622776B2

(12) United States Patent
Ke et al.

(10) Patent No.: US 10,622,776 B2
(45) Date of Patent: Apr. 14, 2020

(54) METHOD FOR FORMING EMBEDDED MEMBERS, PRE-STRUCTURE PREPARED THEREFROM, AND POSITIONING SCRAP

(71) Applicant: STARCONN ELECTRONIC (SU ZHOU) CO., LTD, Kunshan, Jiangsu Province (CN)

(72) Inventors: Yu-Feng Ke, Taoyuan County (TW); Sun-Yu Chou, New Taipei (TW); Chia-Feng Huang, New Taipei (TW)

(73) Assignee: STARCONN ELECTRONIC (SU ZHOU) CO., LTD, Kunshan, Jiangsu Province (CN)

( * ) Notice: Subject to any disclaimer, the term of this patent is extended or adjusted under 35 U.S.C. 154(b) by 674 days.

(21) Appl. No.: 15/204,046

(22) Filed: Jul. 7, 2016

(65) Prior Publication Data

US 2017/0288359 A1 Oct. 5, 2017

(30) Foreign Application Priority Data

Apr. 1, 2016 (TW) ..... 105110548 A

(51) Int. Cl.
*H01R 43/16* (2006.01)
*B26F 1/38* (2006.01)

(52) U.S. Cl.
CPC ..... *H01R 43/16* (2013.01); *B26F 1/38* (2013.01); *Y10T 29/49121* (2015.01); *Y10T 29/49204* (2015.01)

(58) Field of Classification Search
CPC ..... H01R 43/16; Y10T 29/49121; Y10T 29/49204
See application file for complete search history.

(56) References Cited

U.S. PATENT DOCUMENTS 5,584,709 A * 12/1996 Kiat ..... H01R 12/727 439/79
5,661,448 A * 8/1997 Totsuka ..... H01H 85/044 29/623
6,141,872 A * 11/2000 Takanashi ..... H01R 43/16 29/827
2008/0254688 A1* 10/2008 Bogursky ..... H01R 13/113 439/858
2009/0149070 A1* 6/2009 Feng ..... H01R 43/16 439/630

* cited by examiner

*Primary Examiner* — Livius R. Cazan
(74) *Attorney, Agent, or Firm* — Gang Yu

(57) ABSTRACT

A method includes the steps: providing a pre-structure comprising a first pre-embedded member and a second pre-embedded member, wherein the first pre-embedded member has a first positioning segment, a connecting segment connected to the first positioning segment, a first piece, and a bridge; the second pre-embedded member has a second positioning segment, a hanging segment connected to the second positioning segment, and a second piece, wherein the bridge is connected to the connecting segment and the second piece; fixing the bridge onto the hanging segment; segmenting the connecting portion of the bridge and the connecting segment to form a first embedded member, which is defined by the first positioning segment, the connecting segment and the first piece, and a second embedded member, which is defined by the second positioning segment, the hanging segment, the second piece and the bridge; separating the second embedded member from the first embedded member.

6 Claims, 15 Drawing Sheets

METHOD FOR FORMING EMBEDDED MEMBERS, PRE-STRUCTURE PREPARED THEREFROM, AND POSITIONING SCRAP

BACKGROUND OF THE INVENTION

1. Field of the Invention

The instant invention relates to an embedded member; in particular, to a method for forming at least two kinds of embedded members, a pre-structure prepared therefrom, and a positioning scrap.

2. Description of Related Art

The conventional method provides for forming only one embedded member by punching a metallic strip, that is to say, each kind of embedded member must be produced by using one punching mold correspondingly. Thus, the punching mold needs to be adjusted by draining high manpower cost, besides, the conventional method produces too much waste material, so that the conventional method has high production cost and poor efficiency.

For example, please refer to FIGS. 1 through 3, which respectively show three kinds of embedded members for different signal wafers. As shown in FIG. 1, a metallic strip is punched by a first punching mold to form a first embedded member, the first embedded member has a rectangular positioning scrap P and five terminals T fixed inside the positioning scrap P. When the first embedded member is used in an insert molding process, the positioning scrap P is provided for setting on a first mold to avoid displacement of each terminal T. As shown in FIG. 2, a metallic strip is punched by a second punching mold to form a second embedded member, the second embedded member has a rectangular positioning scrap P and two terminals T fixed inside the positioning scrap P. Compared to FIG. 1, three terminals not shown in FIG. 2 are separated from the positioning scrap P, so the three terminals not shown in FIG. 2 cannot be fixed by using the positioning scrap P. Thus, the three terminals not shown in FIG. 2 cannot be applied in an insert molding process and will be as waste material. As shown in FIG. 3, a metallic strip is punched by a third punching mold to form a third embedded member, the third embedded member has a rectangular positioning scrap P and three terminals T fixed inside the positioning scrap P. Compared to FIG. 1, two terminals not shown in FIG. 3 are separated from the positioning scrap P, so the two terminals not shown in FIG. 3 cannot be fixed by using the positioning scrap P. Thus, the two terminals not shown in FIG. 3 cannot be applied in an insert molding process and will be as waste material.

SUMMARY OF THE INVENTION

The instant disclosure provides a method for forming at least two kinds of embedded members, a pre-structure prepared therefrom, and a positioning scrap for effectively improving the problem generated from the conventional method.

Specifically, compared to the prior art of FIGS. 1 through 3, the instant disclosure intends to change the construction of the first punching mold, such that an embedded member after formed by the changed first punching mold can be punched by the other punching mold to form two kinds of embedded members, which can be respectively applied in two insert molding processes, corresponding to FIGS. 2 and 3, thereby the cost will decrease by reducing waste material and will increase producing efficiency.

The instant disclosure provides a method for forming at least two kinds of embedded members, comprising: implementing a punching step by punching a sheet-like metallic strip to form an integral pre-structure having a first pre-embedded member and a second pre-embedded member, wherein the first pre-embedded member has a first positioning segment, a connecting segment connected to the first positioning segment, at least one first piece connected to the connecting segment, and at least one bridge, wherein the second pre-embedded member has a second positioning segment, a hanging segment connected to the second positioning segment, and at least one second piece, wherein the at least one bridge has a first end portion and a second end portion, the first end portion is integrally connected to the connecting segment and the at least one second piece, and the second end portion is a free end of the at least one bridge; implementing a connecting step by fixing the at least one bridge to the hanging segment; implementing a cutting step by cutting a connection position of the at least one bridge and the connecting segment to form a first embedded member and a second embedded member unconnected to the first embedded member, wherein the first positioning segment, the connecting segment, and the at least one first piece are connected with each other to be defined as the first embedded member, the second positioning segment, the hanging segment, the at least one second piece, and the at least one bridge are connected with each other to be defined as the second embedded member, wherein the first positioning segment and the connecting segment are defined as a first positioning scrap, and the second positioning segment, the hanging segment, and the at least one bridge are defined as a second positioning scrap; and implementing a separating step by separating the second embedded member from the first embedded member.

The instant disclosure also provides a pre-structure, comprising: a first pre-embedded member having a first positioning segment, a connecting segment connected to the first positioning segment, at least one first piece connected to the connecting segment, and at least one bridge connected to the connecting segment; and a second pre-embedded member integrally formed with the first pre-embedded member and having a second positioning segment, a hanging segment connected to the second positioning segment, and at least one second piece connected to the at least one bridge, wherein the at least one bridge has a first end portion and a second end portion, the first end portion is integrally connected to the connecting segment and the at least one second piece, and the second end portion is bendable with respect to the first end portion to fix on the hanging segment.

The instant disclosure further provides a positioning scrap, comprising: a positioning segment having a plurality of positioning holes; a hanging segment integrally connected to the positioning segment; and at least one bridge non-integrally connected to the positioning segment and the hanging segment, wherein the at least one bridge has a first end portion and a second end portion, the first end portion is curvedly extended from the second end portion, the first end portion is a free end of the positioning scrap, and the second end portion is fixed on the hanging segment.

In summary, two kinds of embedded members can be produced in a single process by using the method of the instant disclosure and it can be used to provide different signal wafers, such that waste material can be reduced and the producing time can be effectively decreased.

In order to further appreciate the characteristics and technical contents of the instant invention, references are hereunder made to the detailed descriptions and appended drawings in connection with the instant invention. However, the appended drawings are merely shown for exemplary purposes, rather than being used to restrict the scope of the instant invention.

DETAILED DESCRIPTION OF THE PREFERRED EMBODIMENTS

Please refer to FIGS. 4 through 15, which show an embodiment of the instant disclosure. References are hereunder made to the detailed descriptions and appended drawings in connection with the instant invention. However, the appended drawings are merely shown for exemplary purposes, rather than being used to restrict the scope of the instant invention.

Figure 9:
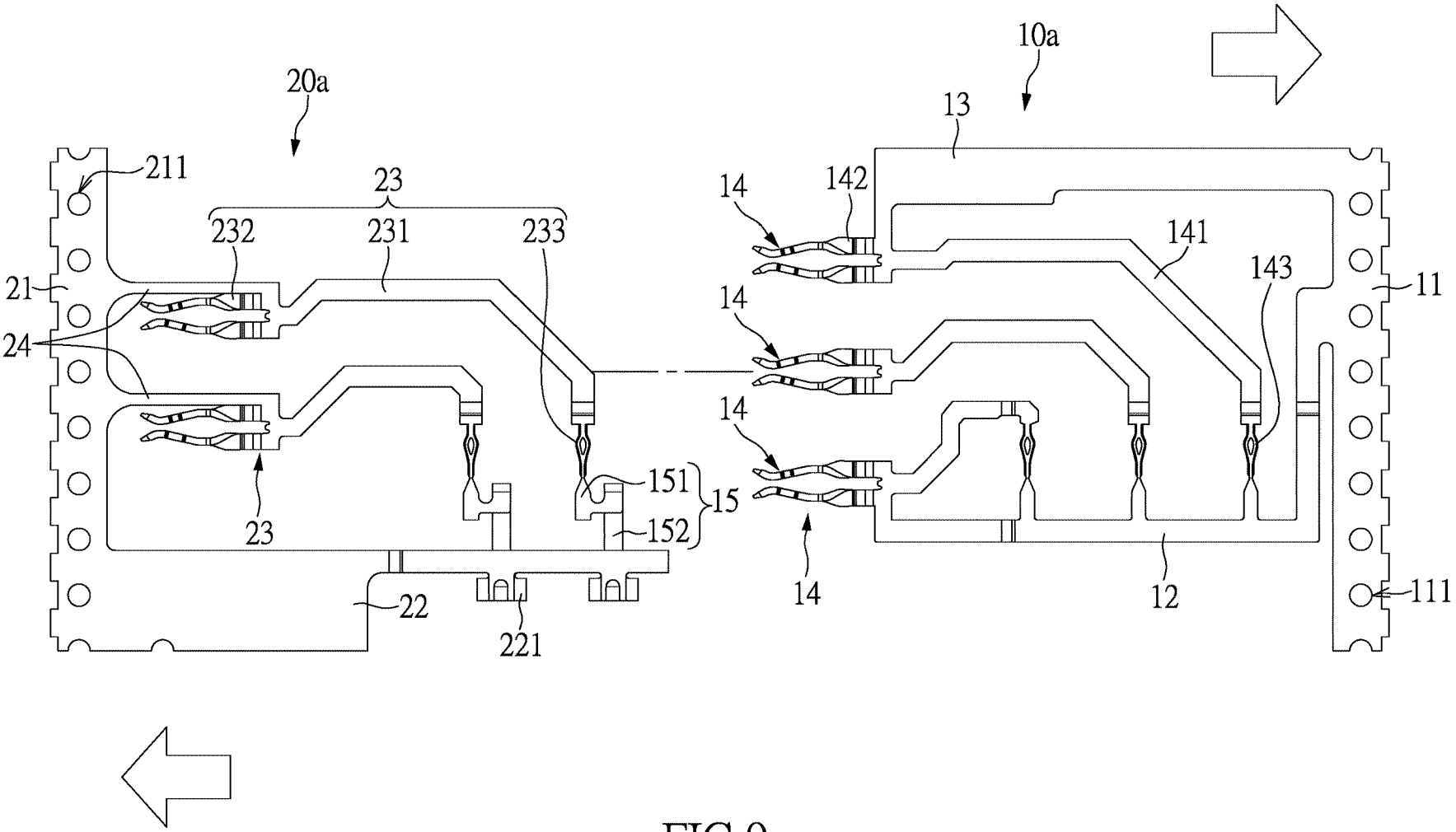
FIG. 9 is a schematic view showing a step S170 of the method according to the instant disclosure.
Figure 11:
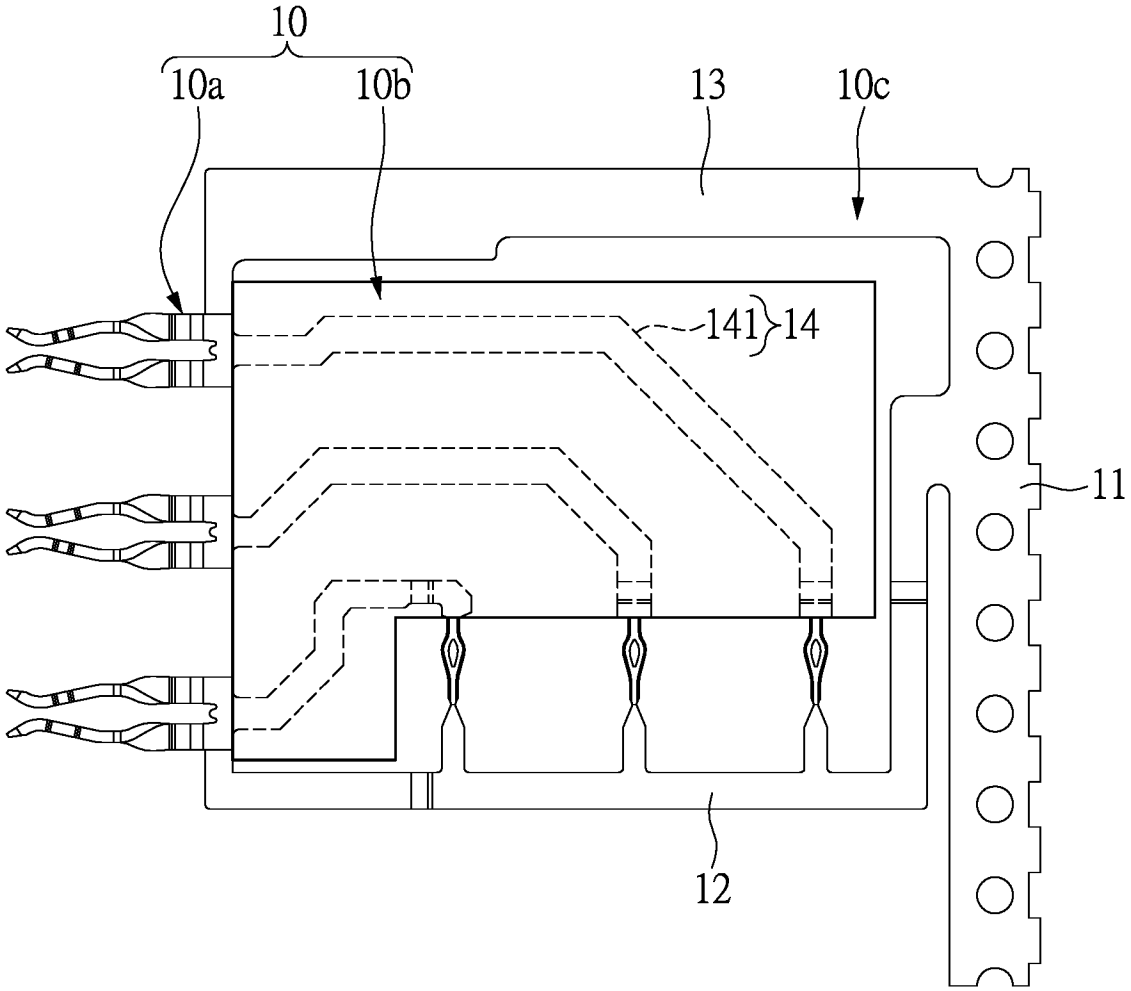
FIG. 11 is a first schematic view showing a step S190 of the method according to the instant disclosure.
Figure 13:
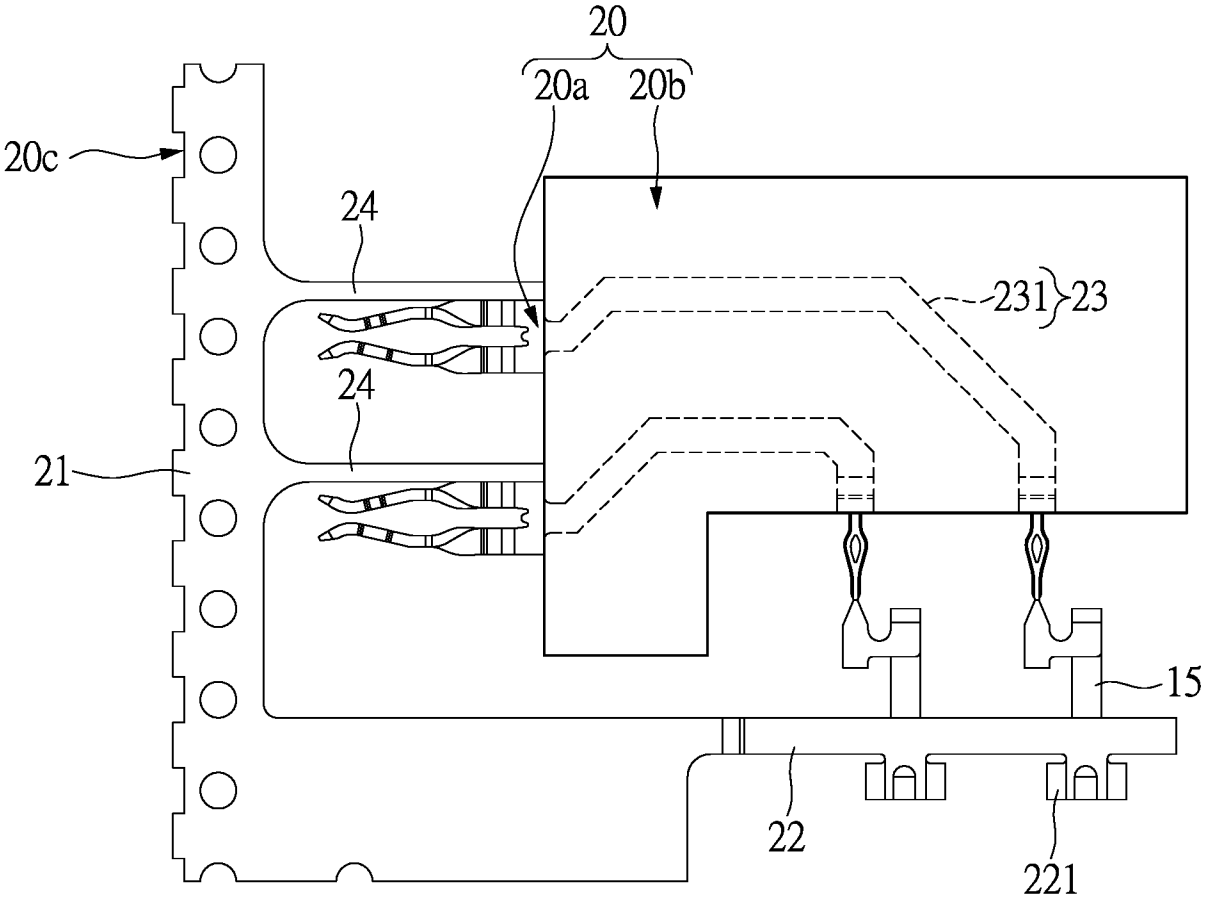
FIG. 13 is a second schematic view showing the step S190 of the method according to the instant disclosure.

Please see FIGS. 9, 11 and 13. The instant embodiment provides a method for forming at least two kinds of embedded members. Specifically, a plurality of semi-finished products (e.g., a first embedded member 10*a* and a second embedded member 20*a*) formed from the same segment of a strip by using the method can be used to form a plurality of end products (e.g., a first signal wafer 10 and a second signal wafer 20) by insert molding, and the method in the instant embodiment is applied to an electrical connector field, but is not limited thereto. For example, the method of the instant disclosure can be applied to a photoelectric field (e.g., LED field or IC field) for forming lead frames or conductive wires.

Figure 15:
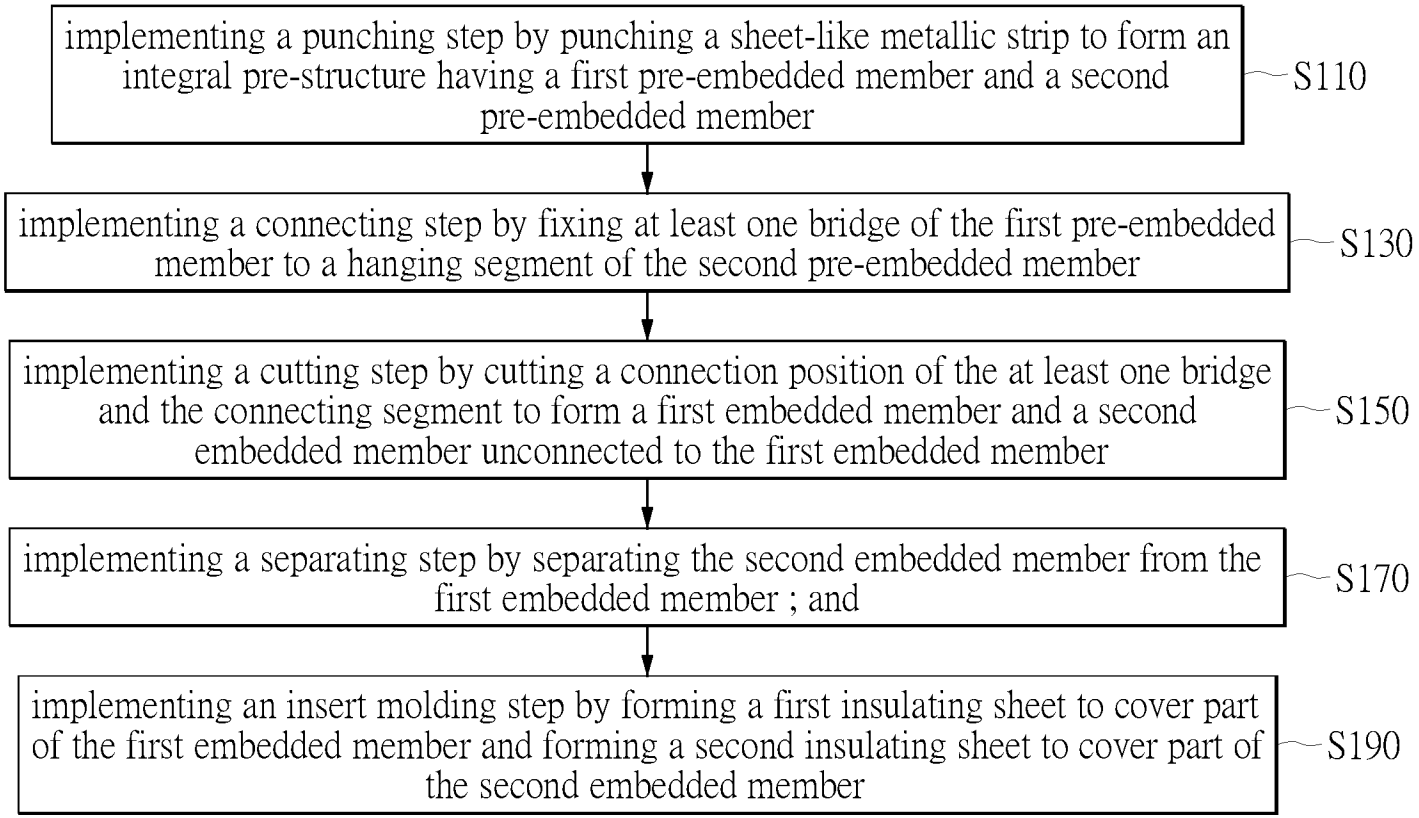
FIG. 15 is a flow chart showing the steps S110~S190 of the method according to the instant disclosure.

The method of the instant embodiment includes the steps S110~S190 (as shown in FIG. 15), but is not limited thereto. The sequence of the steps can be adjusted according to the designer's demand and is not limited to the number and the disclosing sequence of the steps. For example, the following connecting step 130 can be implemented after the cutting step S150.

Figure 1:
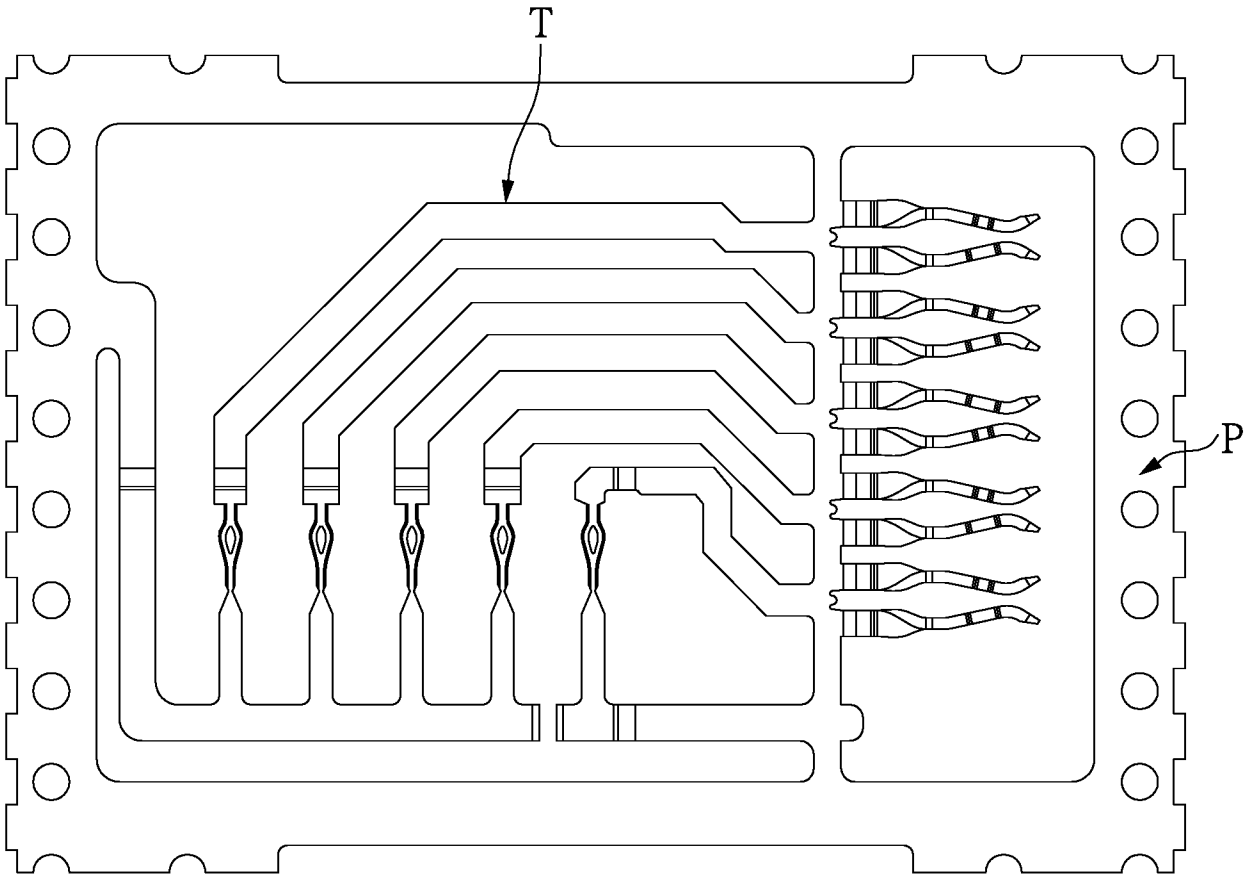
FIG.1 PRIOR ART
FIG. 1 is a schematic view showing a first embedded member formed by adapting a first punching mold according to the conventional method.
Figure 2:
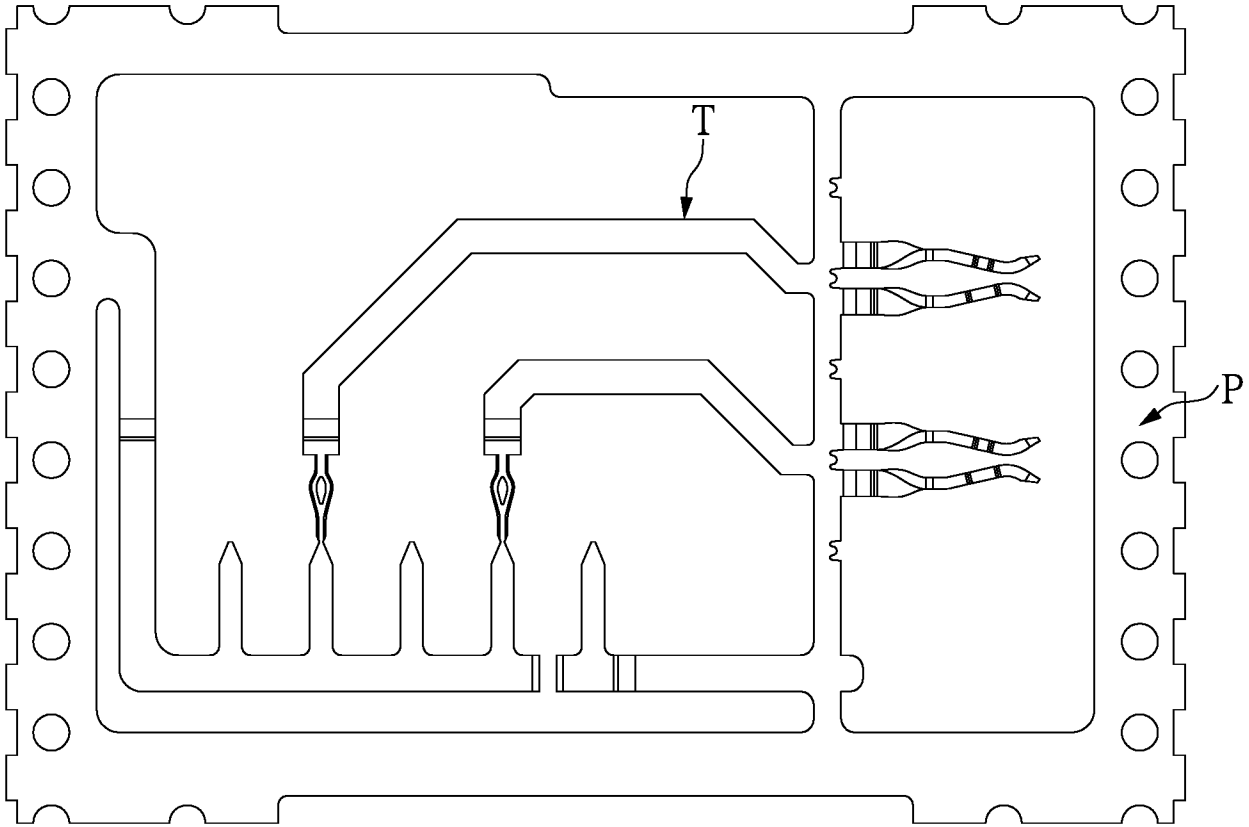
FIG.2 PRIOR ART
FIG. 2 is a schematic view showing a second embedded member formed by adapting a second punching mold according to the conventional method.
Figure 3:
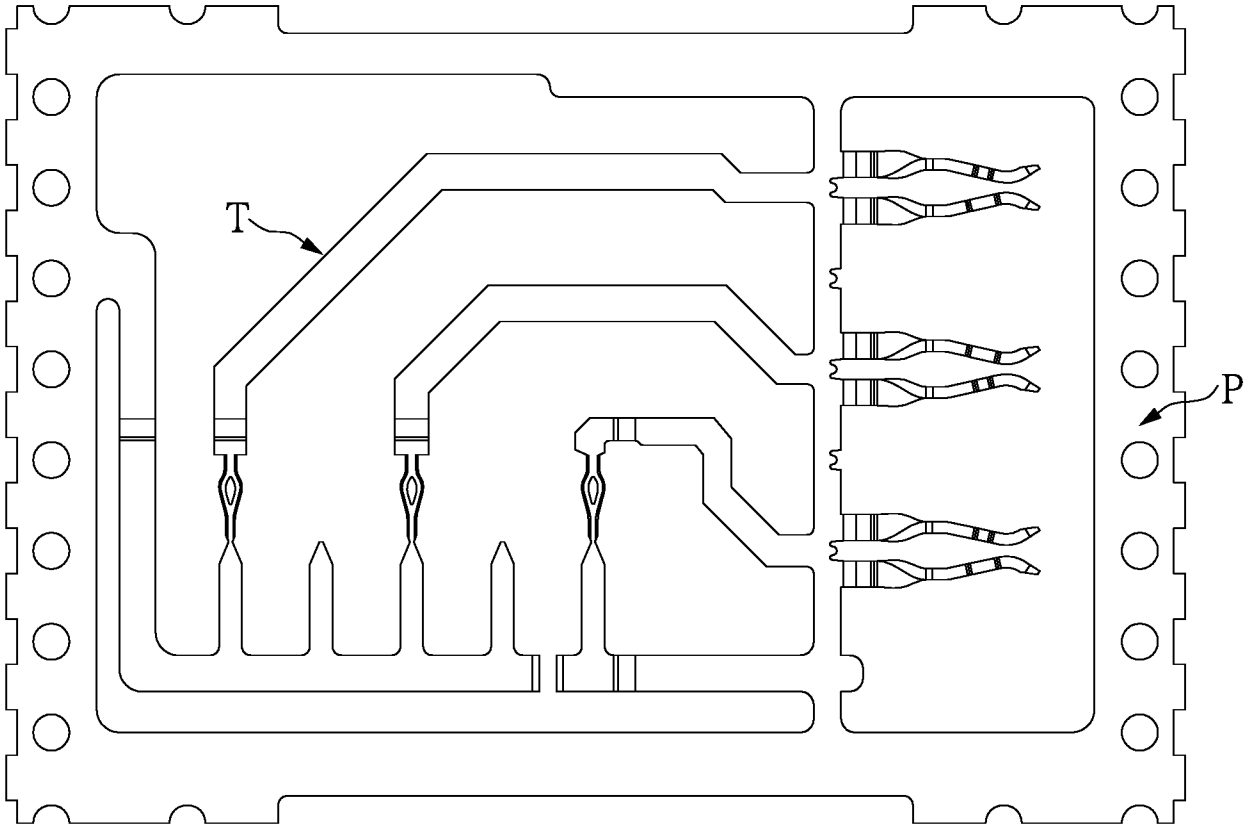
FIG.3 PRIOR ART
FIG. 3 is a schematic view showing a third embedded member formed by adapting a third punching mold according to the conventional method.
Figure 4:
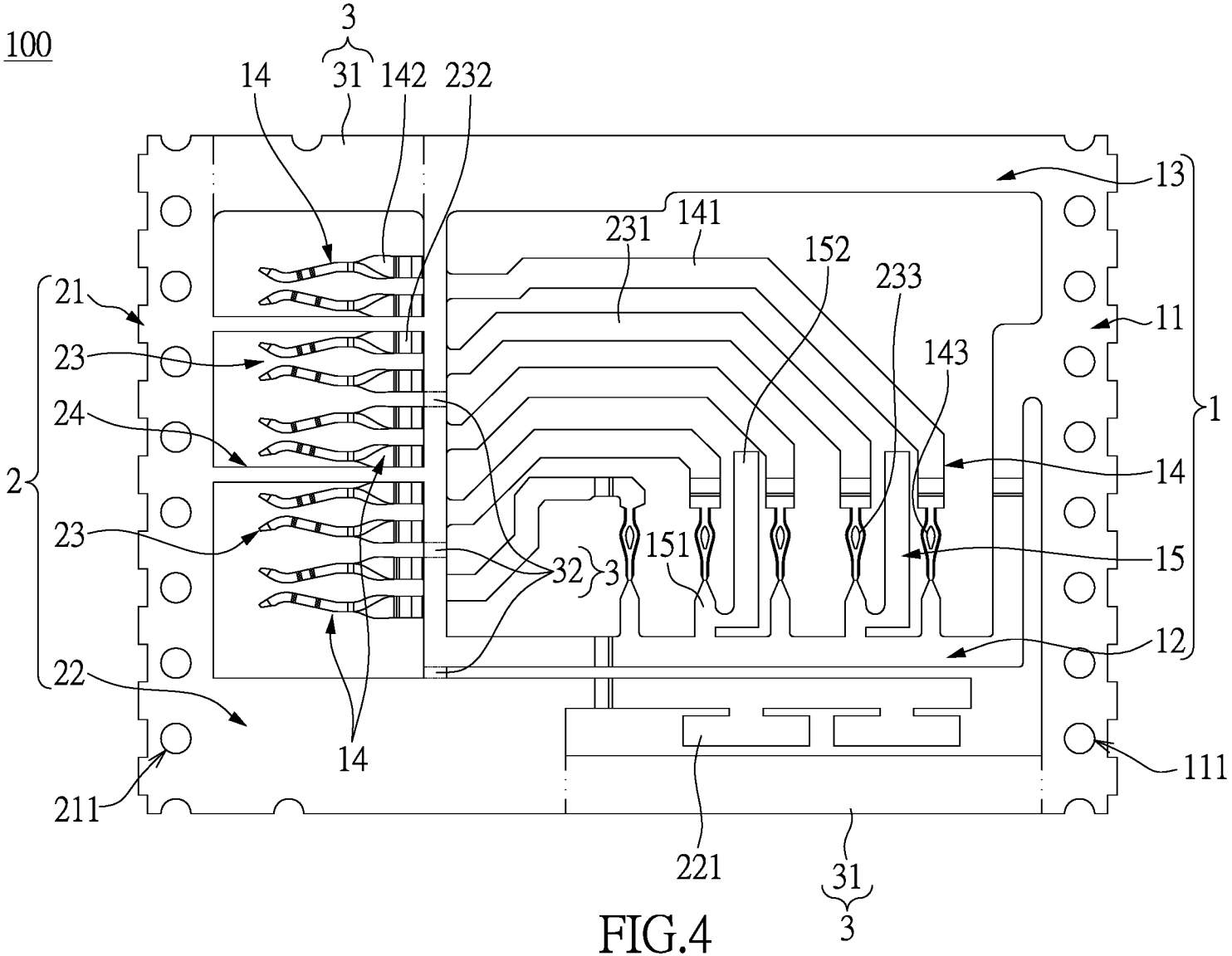
FIG. 4 is a schematic view showing a step S110 of a method according to the instant disclosure.
Figure 5:
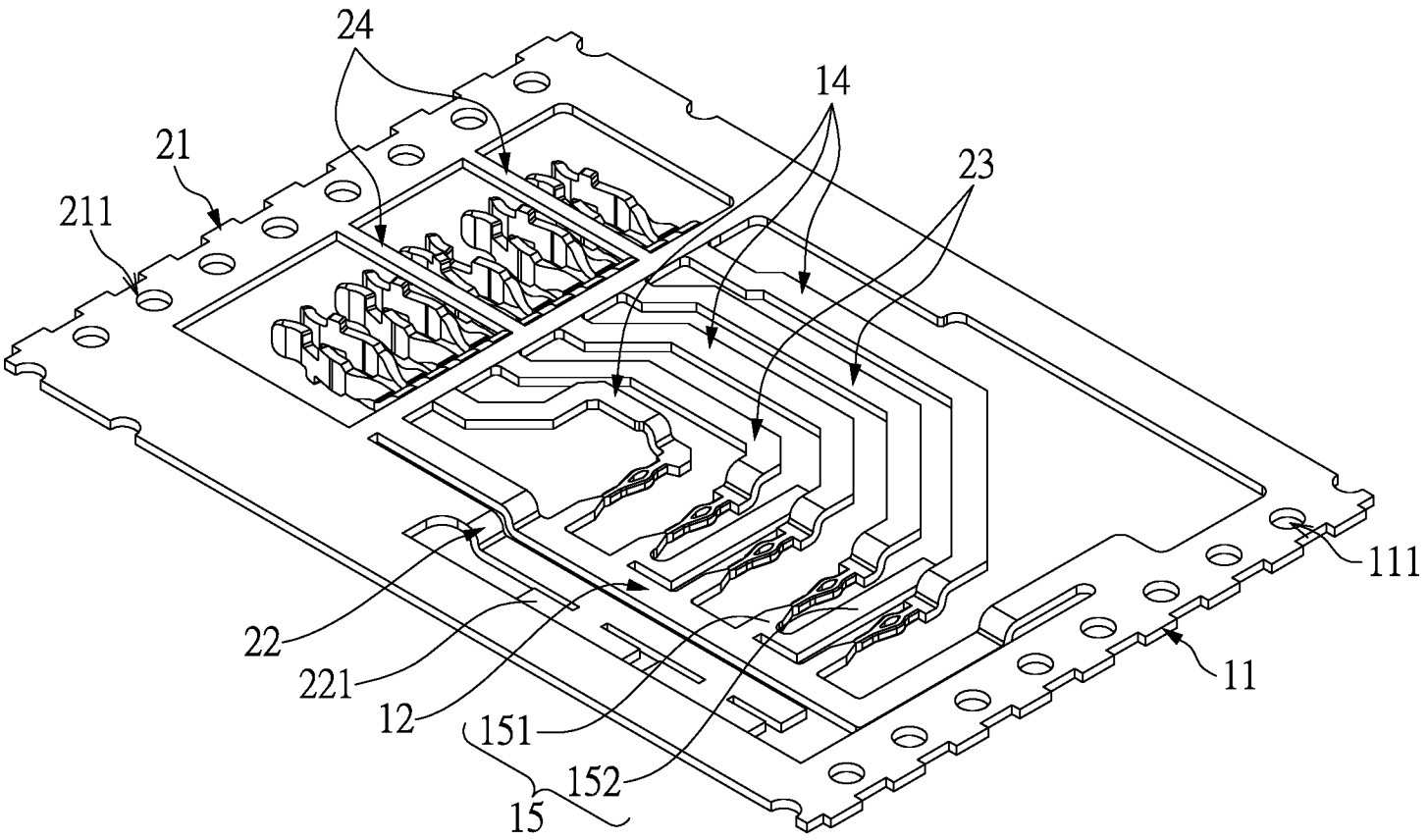
FIG. 5 is a perspective view of FIG. 4.

Please refer to FIGS. 4 and 5, which show a punching step S110. The punching step S110 is implemented by punching a sheet-like metallic strip (not shown) to form an integral pre-structure 100 having a first pre-embedded member 1, a second pre-embedded member 2, and a plurality of sacrificing segments 3. The pre-structure 100 has an approximately rectangular outer edge. Each sacrificing segment 3 connects the first pre-embedded member 1 and the second pre-embedded member 2 to keep the relative position therebetween. The sacrificing segments 3 in the instant embodiment include two outer sacrificing segments 31 and three inner sacrificing segments 32.

The first pre-embedded member 1 has a first positioning segment 11, a connecting segment 12 and an extending segment 13 both connected to the first positioning segment 11, a plurality of first pieces 14 connected to the connecting segment 12, and two bridges 15. The second pre-embedded member 2 has a second positioning segment 21, a hanging segment 22 connected to the second positioning segment 21, a plurality of second pieces 23, and two supporting segments 24. The first pieces 14 and the second pieces 23 in the instant embodiment are terminals of an electrical connector. The first, third, and fifth terminals shown in FIG. 4 or FIG. 5 counted from top to bottom are the first pieces 14, and the second and fourth terminals shown in FIG. 4 or FIG. 5 counted from top to bottom are the second pieces 23.

Each first piece 14 has a first embedded portion 141, a first mating portion 142 and a first mounting portion 143 respectively connected to two opposite ends of the first embedded portion 141. Each second piece 23 has a second embedded portion 231, a second mating portion 232 and a second mounting portion 233 respectively connected to two opposite ends of the second embedded portion 231. However, the construction of each first piece 14 or each second piece 23 is not limited thereto.

Specifically, the first positioning segment 11 and the second positioning segment 21 are elongated and parallel to each other. Each of the first positioning segment 11 and the second positioning segment 21 has a plurality of positioning holes 111, 211 for allowing the strip to equidistantly move between each work station as the strip is continuously punched and providing a positioning function in an insert molding process. The extending segment 13 and the hanging segment 22 are respectively and perpendicularly connected to the first positioning segment 11 and the second positioning segment 21. A connection position of the extending segment 13 and the first positioning segment 11 and a connection position of the hanging segment 22 and the second positioning segment 21 are substantially located at two diagonal corners of the pre-structure 100.

An end of the extending segment 13 arranged away from the first positioning segment 11 is connected to the first mating portion 142 of one of the first pieces 14 (i.e., the top first piece 14 shown in FIG. 4). The end of the extending segment 13 is perpendicularly and indirectly connected to the second positioning segment 21 by one of the outer sacrificing segments 31, and the hanging segment 22 is perpendicularly and indirectly connected to the first positioning segment 11 by the other outer sacrificing segment 31. An end of the hanging segment 22 arranged away from the second positioning segment 21 is a free end thereof. Moreover, the connecting segment 12, the first pieces 14, the bridges 15, the second pieces 23, and the supporting segments 24 are surrounded by a rectangular configuration formed from the first positioning segment 11, the second positioning segment 21, the extending segment 13, the hanging segment 22, and the two outer sacrificing segments 31.

The first embedded portion 141 and the first mounting portion 143 of each first piece 14 and the second embedded portion 231 and the second mounting portion 233 of each second piece 23 are arranged between the extending segment 13 and the connecting segment 12, and the first mounting portions 143 are connected to the connecting segment 12. Moreover, an end of the connecting segment 12 arranged away from the first positioning segment 11 is connected to the first mating portion 142 of one of the first pieces 14 (i.e., the bottom first piece 14 shown in FIG. 4) and is indirectly connected to the hanging segment 22 by one of the inner sacrificing segments 32.

Each bridge 15 has a first end portion 151 and a second end portion 152. The first end portion 151 of each bridge 15 is integrally connected to the connecting segment 12 and is connected to the corresponding second mounting portion 233. The second end portion 152 of each bridge 15 is a free end thereof and is bendable with respect to the corresponding first end portion 151 to fix on the hanging segment 22. In other words, each second end portion 152 is arranged between two adjacent first and second pieces 14, 23 and can be bent along an axis, which is defined by a connection position of the second end portion 152 and the first end portion 151, to fix on the hanging segment 22.

Each supporting segment 24 is integrally and perpendicularly connected to the second positioning segment 21, and an end of each supporting segment 24 arranged away from the second positioning segment 21 is connected to two adjacent first and second mating portions 142, 232. Specifically, please refer to FIG. 4, which shows five terminals arranged from top to bottom. The first mating portion 142 and the second mating portion 232 counted from top to bottom respectively at a first terminal and a second terminal are connected to one of the supporting segments 24, the first mating portion 142 and the second mating portion 232 counted from top to bottom respectively at a third terminal and a fourth terminal are connected to the other supporting segment 24, the second mating portion 232 and the first mating portion 142 counted from top to bottom respectively at the second terminal and the third terminal are connected to another inner sacrificing segment 32, and the second mating portion 232 and the first mating portion 142 counted from top to bottom respectively at the fourth terminal and a fifth terminal are connected to the other inner sacrificing segment 32.

It should be noted that the hanging segment 22 has two sheet-like fixing portions 221 arranged between the connecting segment 12 and the outer sacrificing segment 31 which is connected to the hanging segment 22. The two fixing portions 221 are respectively corresponding in position to the second end portions 152 of the two bridges 15.

Moreover, the number of each part of the pre-structure 100 (e.g., the number of the first pieces 14, the number of the second pieces 23, the number of bridges 15, or the number of the supporting segments 24) and the relative position of each part of the pre-structure 100 (e.g., the position of each supporting segment 24 or the position of each bridge 15) can be changed according to the designer's demand, the instant disclosure is not limited to the instant embodiment. In addition, the pre-structure 100 is preferably provided with the sacrificing segments 3 and the supporting segments 24, but in a non-shown embodiment, the pre-structure can be provided without any sacrificing segment 3 and any supporting segment 24.

Figure 6:
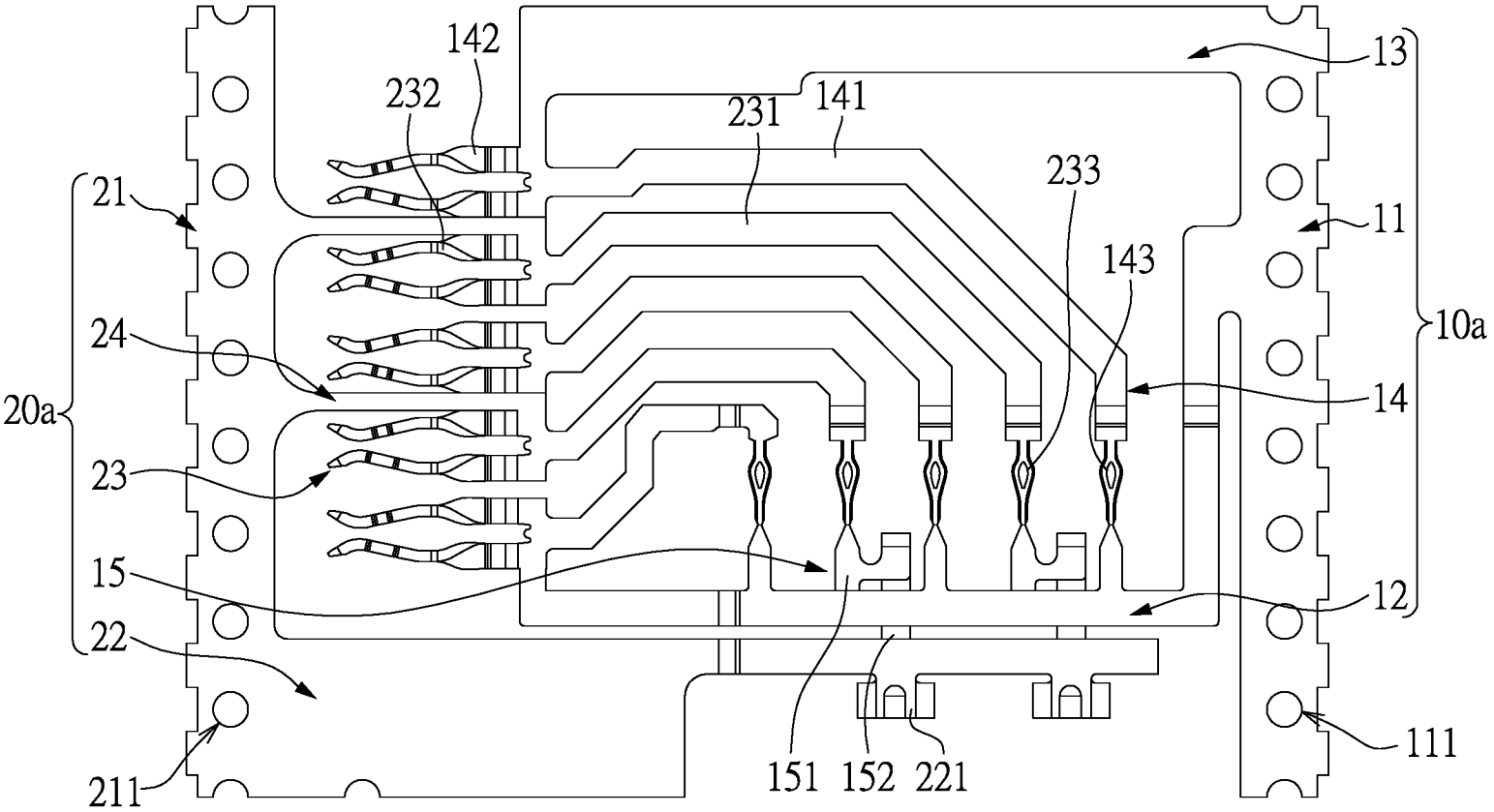
FIG. 6 is a schematic view showing a step S130 and a step S150 of the method according to the instant disclosure.
Figure 7:
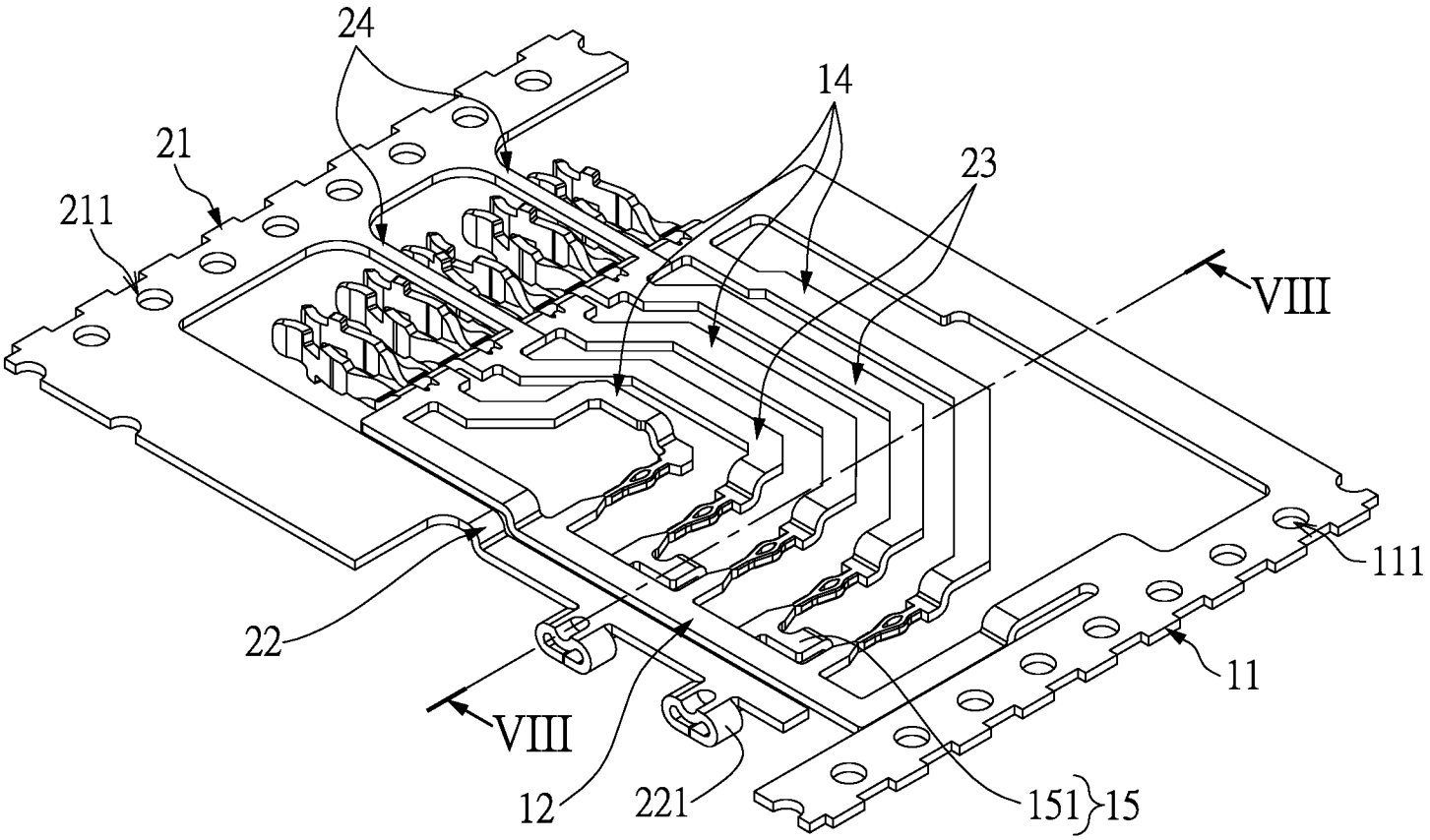
FIG. 7 is a perspective view of FIG. 6.
Figure 8:
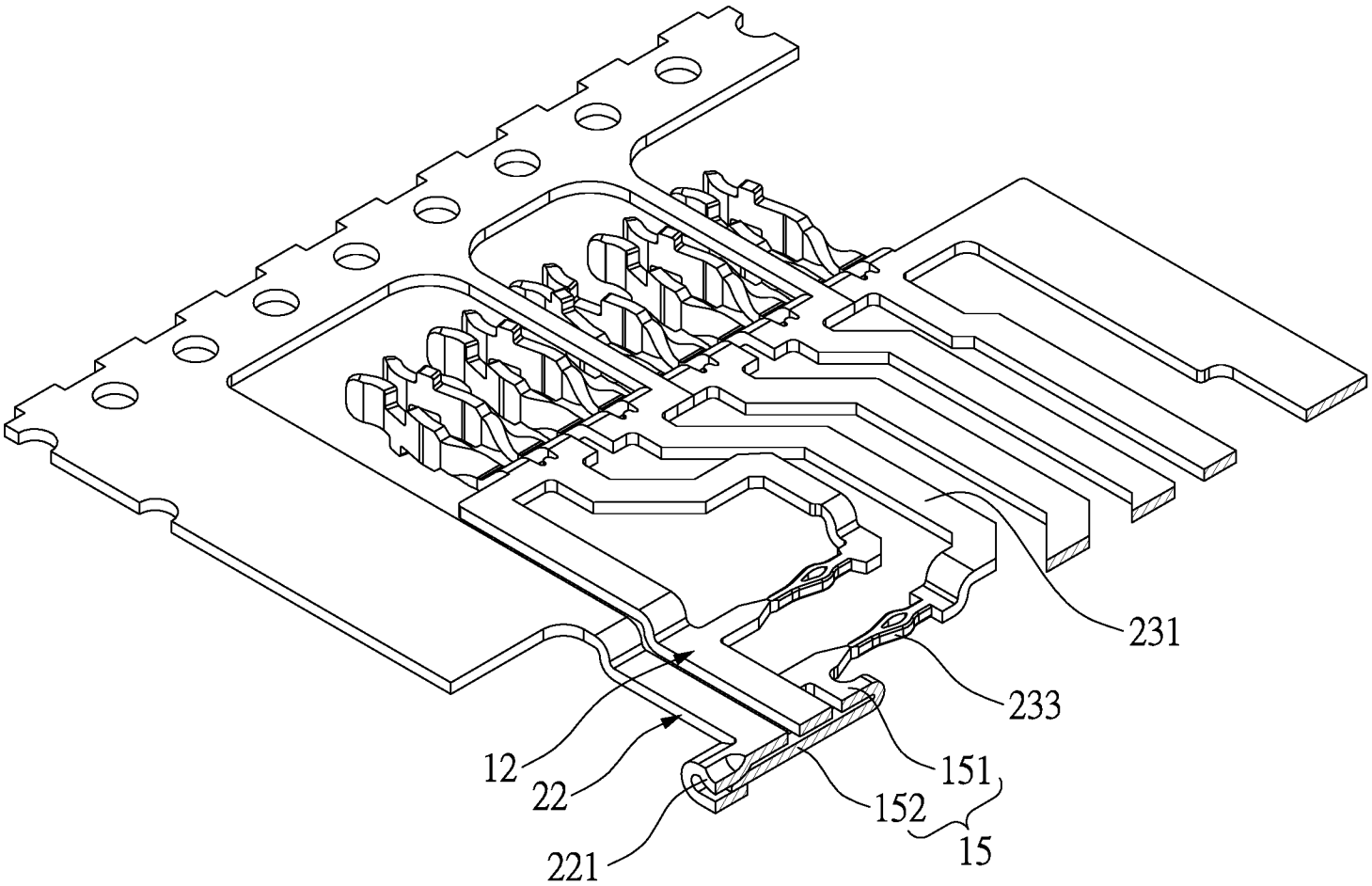
FIG. 8 is a cross-sectional view of FIG. 7.

Please refer to FIGS. 6 through 8, which show a connecting step S130. The connecting step S130 is implemented by respectively fixing the two bridges 15 to the two hanging segments 22. The second end portion 152 of each bridge 15 is bent with respect to the first end portion 151 in 180 degrees onto the corresponding fixing portion 221 of the hanging segment 22 for forming the second end portion 152 and the connected part of the first end portion 151 into a J-shaped construction, and then the fixing portion 221 is deformed to clip the second end portion 152 by pressing the fixing portion 221 and the second end portion 152 after the fixing portion 221 is bent to cover the second end portion 152. However, the bridge 15 in the instant embodiment is provided to connect with the hanging segment 22, so the fixing mode between the bridge 15 and the hanging segment 22 is not limited to the instant embodiment.

Please refer to FIGS. 6 through 8, which show a cutting step S150. The cutting step S150 is implemented by cutting a connection position of each supporting segment 24 and the connected first mating portion 142 to make the one end of each supporting segment 24 to be only connected to the second mating portion 232, removing the sacrificing segments 3 to separate the first pre-embedded member 1 from the second pre-embedded member 2, and cutting a connection position of the first end portion 151 of each bridge 15 and the connecting segment 12 to form a first embedded member 10*a* and a second embedded member 20*a* which is unconnected to the first embedded member 10*a*. Specifically, the first positioning segment 11, the connecting segment 12, the extending segment 13, and the three first pieces 14 are connected with each other to be defined as the first embedded member 10*a*, and the second positioning segment 21, the hanging segment 22, the two second pieces 23, the two supporting segments 24, and the two bridges 15 are connected with each other to be defined as the second embedded member 20*a*.

Figure 10:
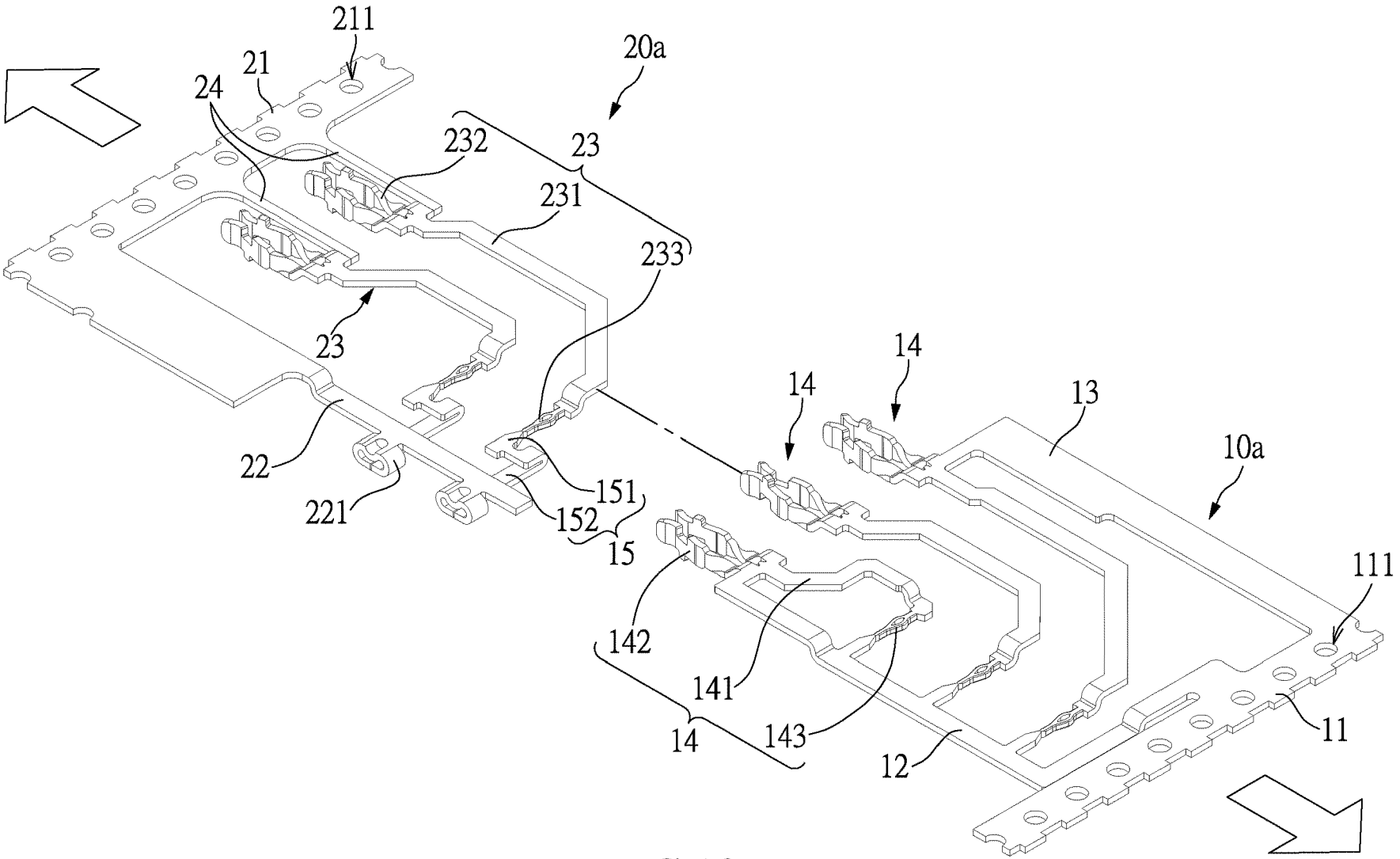
FIG. 10 is a perspective view of FIG. 9.

Please refer to FIGS. 9 and 10, which show a separating step S170. The separating step S170 is implemented by separating the second embedded member 20*a* and the first embedded member 10*a* from each other in two different directions. Accordingly, the first embedded member 10*a* and the second embedded member 20*a* can be suitable for applying to insert molding process. Specifically, in the inserting molding process, the first positioning segment 11 can be installed on a first mold (not shown) for positioning the first embedded member 10*a*, and the connecting segment 12 and the extending segment 13 are used to maintain the positions of two opposite ends of the corresponding first pieces 14. In the other inserting molding process, the second positioning segment 21 can be used to fix on a second mold (not shown) for positioning the second embedded member 20*a*, and the hanging segment 22, the bridges 15, and the supporting segments 24 are used to maintain the positions of two opposite ends of each second piece 23.

After the steps S110~S170 of the method are implemented, the first embedded member 10*a* and the second embedded member 20*a* can be obtained. Thus, two kinds of embedded members 10*a*, 20*a* can be produced in a single process by using the method of the instant embodiment and can be used to provide different signal wafers, such that the waste material problem can be improved and the producing time can be effectively decreased.

Figure 12:
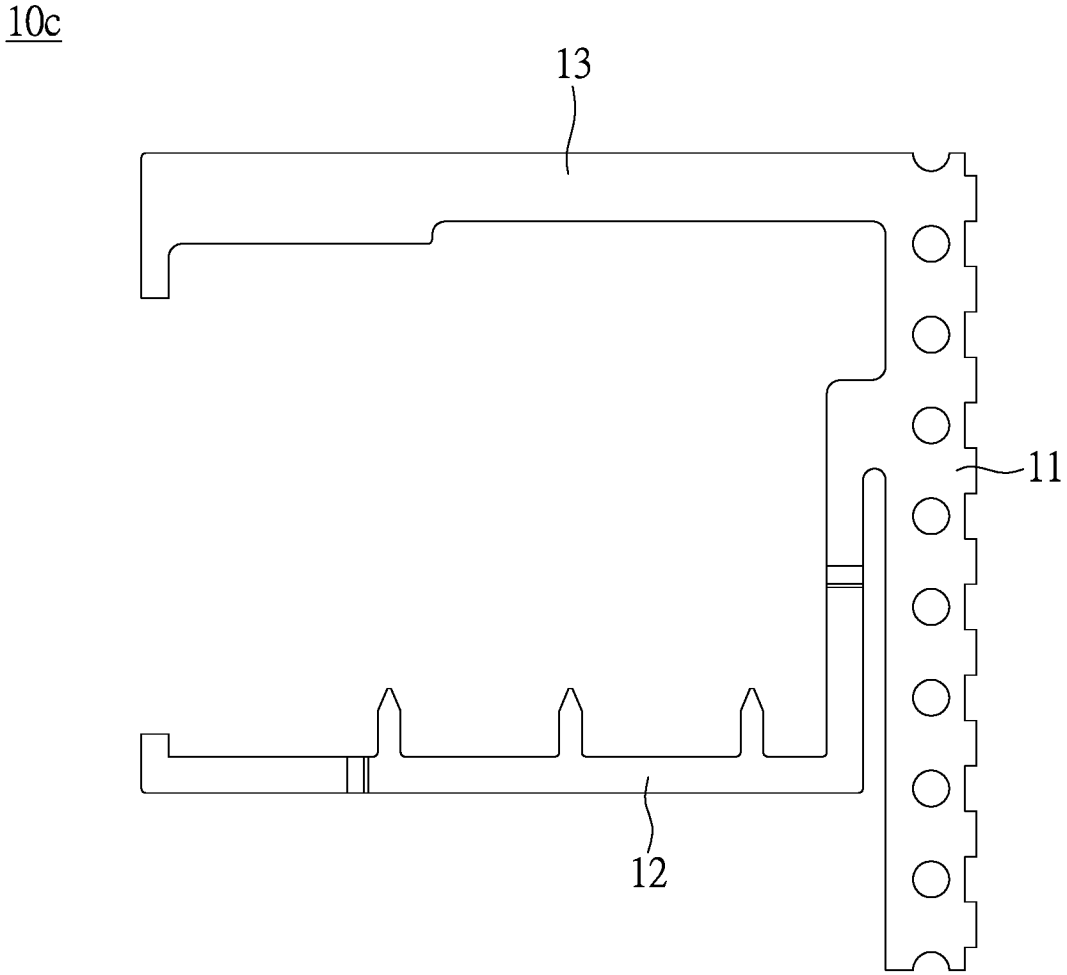
FIG. 12 is a schematic view showing a first positioning scrap according to the instant disclosure.

In addition, the instant embodiment can further include an insert molding step S190 after the step S170. As shown in FIG. 11, a first insulating sheet 10*b* is formed to cover the first embedded portions 141 after the first embedded member 10*a* is disposed in the first mold (not shown), and then the first pieces 14 are separated from the extending segment 13 and the connecting segment 12 to form a first signal wafer 10 which comprises the first pieces 14 and the first insulating sheet 10*b*. The first positioning segment 11, the extending segment 13, and the connecting segment 12 are defined as a first positioning scrap 10*c* (as shown in FIG. 12). Moreover, as shown in FIG. 13, a second insulating sheet 20*b* is formed to cover the second embedded portions 231 after the second embedded member 20*a* is disposed in the second mold (not shown), and then the second pieces 23 are separated from the bridges 15 and the supporting segments 24 to form a second signal wafer 20 which comprises the second pieces 23 and the second insulating sheet 20*b*. The second positioning segment 21, the hanging segment 22, the supporting segments 24, and the bridges 15 are defined as a second positioning scrap 20*c* (as shown in FIG. 14).

It should be noted that each one of the first positioning scrap 10*c* and the second positioning scrap 20*c* can be regarded simply as a positioning scrap because the terms "first" and "second" are only used to distinguish the two positioning scraps for easily understanding the instant embodiment. For the same reason, each one of the first positioning segment 11 and the second positioning segment 21 can be regarded simply as a positioning segment.

Figure 14:
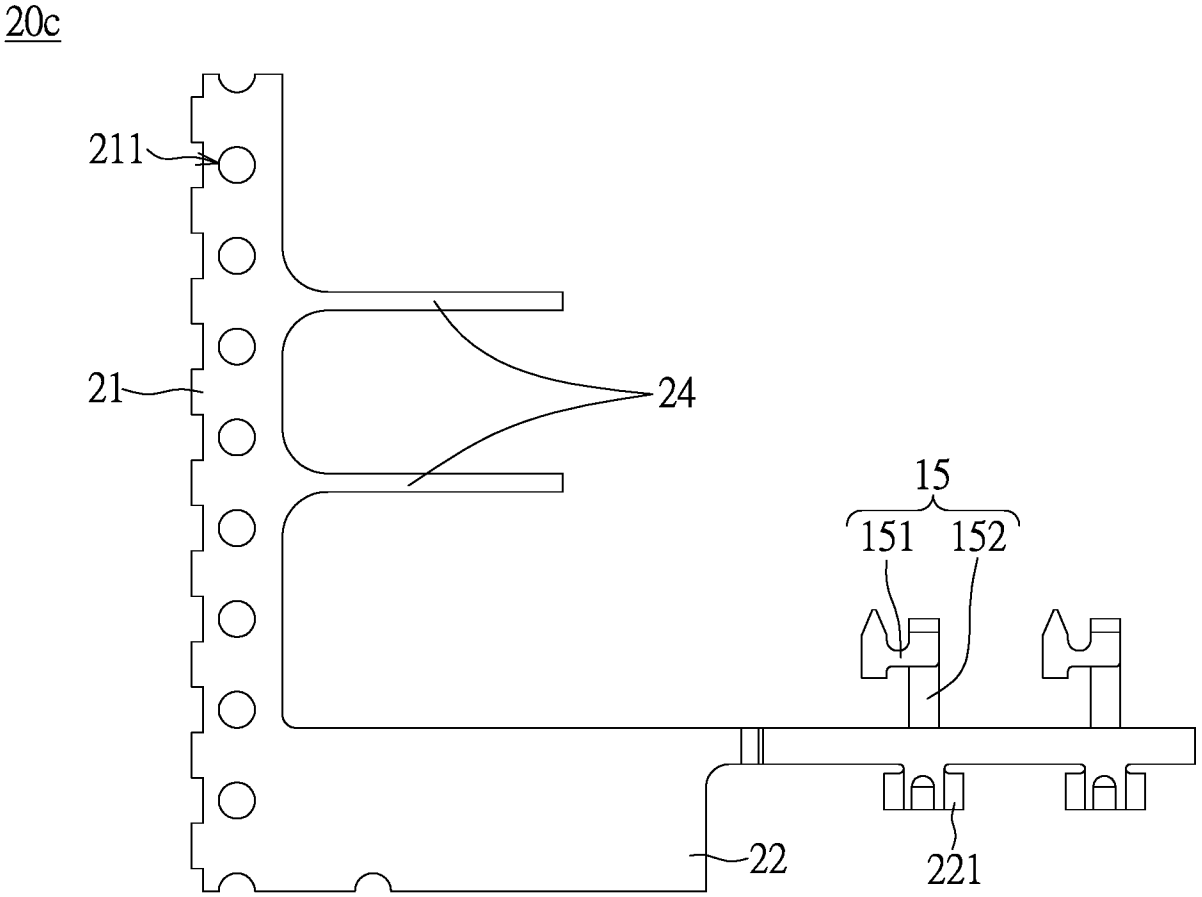
FIG. 14 is a schematic view showing a second positioning scrap according to the instant disclosure.

Moreover, the positioning scrap 20*c* shown in FIG. 14 is a unique structure after the method is implemented, that is to say, the reason that the method can be implemented is based on the construction of the positioning scrap 20*c*. In other words, the first embedded member 10*a* and the second embedded member 20*a* which can be formed and then suitable for applying to an insert molding process are based on the construction of the positioning scrap 20*c*, so the positioning scrap 20*c* is different from conventional scrap. The instant embodiment discloses the positioning scrap 20*c* in the following description.

The positioning scrap 20*c* includes a positioning segment 21, a hanging segment 22, two supporting segments 24, and two bridges 15. The positioning segment 21, the hanging segment 22, and the two supporting segments 24 are integrally formed in one piece, and the bridges 15 are not integrally connected to the positioning segment 21, the hanging segment 22, and the two supporting segments 24.

The positioning segment 21 has a plurality of positioning holes 211 arranged in a longitudinal direction thereof for installing on a mold (not shown). The hanging segment 22 and the supporting segments 24 are perpendicularly connected to the positioning segment 21. An end of each supporting segment 24 arranged away from the positioning segment 21 is a free end. A distance between the hanging segment 22 and the adjacent supporting segment 24 is less than or equal to half of a length of the positioning segment 21.

Each bridge 15 has a first end portion 151 and a second end portion 152. Each first end portion 151 is curvedly extended from the corresponding second end portion 152 in 180 degrees. Each first end portion 151 is a free end of the positioning scrap 20*c*. The two fixing portions 221 of the hanging segment 22 respectively cover and fix the two second end portions 152.

[The Possible Effect of the Instant Disclosure]

In summary, two kinds of embedded members can be produced in a single process by using the method of the instant disclosure and can be used to provide different signal wafers, such that the waste material problem can be improved and the producing time can be effectively decreased.

Moreover, the method of the instant disclosure can be implemented partially based on the construction of the second positioning scrap. In other words, the first embedded member and the second embedded member which can be formed and then suitable for applying to an insert molding process are based on the construction of the second positioning scrap, so the second positioning scrap is different from conventional scrap.

The descriptions illustrated supra set forth simply the preferred embodiments of the instant invention; however, the characteristics of the instant invention are by no means restricted thereto. All changes, alterations, or modifications conveniently considered by those skilled in the art are deemed to be encompassed within the scope of the instant invention delineated by the following claims.

What is claimed is:

1. A method for forming at least two kinds of embedded members, comprising:

implementing a punching step by punching a sheet-like metallic strip to form an integral pre-structure having a first pre-embedded member and a second pre-embedded member, wherein the first pre-embedded member has a first positioning segment, a connecting segment connected to the first positioning segment, at least one first piece connected to the connecting segment, and at least one bridge, wherein the second pre-embedded member has a second positioning segment, a hanging segment connected to the second positioning segment, and at least one second piece, wherein the at least one bridge has a first end portion and a second end portion, the first end portion is integrally connected to the connecting segment and the at least one second piece, and the second end portion is a free end of the at least one bridge;

implementing a connecting step by fixing the at least one bridge to the hanging segment;

implementing a cutting step by cutting a connection position of the at least one bridge and the connecting segment to form a first embedded member and a second embedded member unconnected to the first embedded member, wherein the first positioning segment, the connecting segment, and the at least one first piece are connected with each other to be defined as the first embedded member, and the second positioning segment, the hanging segment, the at least one second piece, and the at least one bridge are connected with each other to be defined as the second embedded member, wherein the first positioning segment and the connecting segment are defined as a first positioning scrap, and the second positioning segment, the hanging segment, and the at least one bridge are defined as a second positioning scrap; and implementing a separating step by separating the second embedded member from the first embedded member.

2. The method as claimed in claim 1, wherein in the punching step, the at least one first piece has a first embedded portion, a first mating portion and a first mounting portion respectively connected to two opposite ends of the first embedded portion, the first mounting portion is connected to the connecting segment, the at least one second piece has a second embedded portion, a second mating portion and a second mounting portion respectively connected to two opposite ends of the second embedded portion, and the second mounting portion is connected to the first end portion of the at least one bridge.

3. The method as claimed in claim 2, wherein in the punching step, the second pre-embedded member has at least one supporting segment integrally and perpendicularly connected to the second positioning segment, an end of the at least one supporting segment arranged away from the second positioning segment is connected to the first mating portion and the second mating portion; wherein in the cutting step, a connection position of the at least one supporting segment and the first mating portion is cut to make the end of the at least one supporting segment to be only connected to the second mating portion.

4. The method as claimed in claim 1, wherein the pre-structure has a plurality of sacrificing segments each connected to the first pre-embedded member and the second pre-embedded member; wherein in the cutting step, the sacrificing segments are removed to separate the first pre-embedded member from the second pre-embedded member.

5. The method as claimed in claim 1, wherein in the connecting step, the second end portion of the at least one bridge is bent with respect to the first end portion onto the hanging segment, and then the second end portion is fixed on the hanging segment.

6. The method as claimed in claim 5, wherein the hanging segment has a fixing portion; wherein in the connecting step, the second end portion of the at least one bridge is bent with respect to the first end portion onto the fixing portion of the hanging segment, and then the fixing portion is deformed to clip the second end portion by pressing the fixing portion and the second end portion after the fixing portion is bent to cover the second end portion.

* * * * *